United States Patent [19]

Tenconi

[11] 4,027,503

[45] June 7, 1977

[54] PATTERN DRUM WITH PATTERN SIZE INCREASING APPARATUS

[76] Inventor: Riccardo Tenconi, Via Tallera, 19, Bobbiate-Varese, Italy

[22] Filed: July 19, 1974

[21] Appl. No.: 490,162

[30] Foreign Application Priority Data

July 25, 1973 Italy ..... 27084/73

[52] U.S. Cl. ..... 66/50 B

[51] Int. Cl.[2] ..... D04B 15/74

[58] Field of Search ..... 66/50 B, 154 R, 155, 66/156, 50 A, 50 R

[56] References Cited

UNITED STATES PATENTS

| | | | |
|---|---|---|---|
| 1,933,542 | 11/1933 | Albertman et al. | 66/50 R X |
| 2,030,815 | 2/1936 | Ferneman | 66/50 A |
| 3,075,372 | 1/1963 | Philip | 66/50 A |
| 3,122,905 | 3/1964 | Gutschmit | 66/50 A |
| 3,145,548 | 8/1964 | Mishcon | 66/50 A |
| 3,313,128 | 4/1967 | Schmidt et al. | 66/50 A |
| 3,641,786 | 2/1972 | Burdett et al. | 66/50 B |
| 3,783,640 | 1/1974 | Bourgeois | 66/50 B |

*Primary Examiner*—Mervin Stein

*Assistant Examiner*—Andrew M. Falik

[57] ABSTRACT

A circular knitting machine for manufacturing knitted fabrics having patterning effects with a device for increasing the size of the pattern obtainable on the fabric, comprising a needle cylinder provided with needles and needle pushers and at least one pattern drum disposed peripherally with respect to the needle cylinder and provided with a plurality of variously disposed teeth for operating the selection of the needle pushers and needles according to the pattern to be reproduced. The drum is disposed to roll on the needle cylinder and has the teeth disposed at a pitch equal to that of the needles of the needle cylinder. The machine also comprises means for driving the pattern drum which give it a rotational speed about its own axis and a revolving speed about the needle cylinder such that two facing generatrixes of the cylinder and drum become mutually phase displaced after each complete revolution of the drum about the cylinder. Means are also provided for returning the drum to the condition in which said generatrixes are facing each other after a determined number of revolutions of the pattern drum about the needle cylinder.

3 Claims, 12 Drawing Figures

PATTERN DRUM WITH PATTERN SIZE INCREASING APPARATUS

BACKGROUND OF THE INVENTION

This invention relates to a circular knitting machine for forming knitted fabrics having patterning effects, with adevice for increasing the size of the pattern obtainable on the fabric.

In circular knitting machines, the patterns are obtained on the manufactured product by suitably selecting the needles. In particular this is done on large diameter machines which comprise a number of thread feeds, for example of different colours, and where the knitted fabric obtained is of relatively large size.

A problem which arises in these machines, whether of the type in which the fabric is obtained in tubular form and then cut along a generatrix, or of the type for forming open tubular fabric, is that of obtaining a sufficiently large pattern. in this respect, the width of the pattern is limited by the possibility of needle selection, i.e. in substance by the number of available butts on the needle or jacks for selecting the needles, this number being limited for constructional reasons, and by the number of selection levers which can be disposed in the narrow space available without obstructing each other. The pattern height is a function of the number of feeds, in the sense that if the feeds are increased due to the fact that more courses are knitted simultaneously the pattern height is also increased, except where the pattern is obtained with a color effect, and then the respective heights are reduced to one half in the case of two colours, one third in the case of three colours and so on.

SUMMARY OF THE INVENTION

One object of the present invention is to obtain an increase in size of the pattern by suitably increasing the possibility of needle selection.

In resolving this problem, the present invention starts from a known constructional embodiment of a circular machine, particularly of the large diameter type.

A system is in fact known in which a drum rotatable about the machine cylinder is used for needle selection, i.e. for pushing the butts of the needle pushers inside the grooves in the machine cylinder, so rendering the needle pusher and the relative needle above it inoperative, or for leaving the needle pushers projecting from the respective grooves and therefore operable by the respective working cams for acting on the needles, the machine being of the fixed cylinder type with rotating cams. Discs are provided on this drum with teeth or others projections in accordance with a predetermined pattern, so that as the drum rotates about the cylinder these teeth operate on the corresponding butts of the needle pushers to give the required selection in accordance with the programmed arrangement of the teeth on the drum discs. Evidently the distance between the disc teeth is equal to the distacne between the grooves of the cylinder containing the needles.

The present invention utilises the fact that the drum may be made with discs having a relatively large number of teeth, which allows the selection and hence the width of the pattern to be increased. Thus a pattern is obtained having a width equal to the maximum possible number of teeth on the drum disc.

The invention also makes use of the following consideration. If after one complete revolution of the drum about the cylinder a given generatrix of the pattern durm, that is an ideal longitudinal straight line of the peripheral surface of the pattern drum, whose rotation generates the peripheral surface of the pattern drum, newly faces that generatrix of the cylinder faced at the previous revolution (the generatrix of the needle cylinder being intended as an ideal longitudinal straight line of the peripheral surface of the cylinder, whose rotation generates the surface of the cylinder), the pattern will be reproduced equally in that each needle recieves the same control at each turn. A pattern will be obtained having a width in terms of stitches equal to the maximum number of teeth of a disc of the pattern drum, but its height in terms of rows will be equal to the number of feeds, i.e. a limited height. If however the drum arrives at the initial point (reference generatrix) with a different generatrix than the former one, then another set of teeth will act on the same needle pushers as before, i.e. there will be another selection if these teeth are provided in a different arrangement from the first ones acting on the needle pushers. Thus at each turn there will be a different selection until, after a certain number of turns, the initial conditions are again reached in which the cylinder generatrix taken as the reference line is again facing the corresponding reference generatrix of the drum. In this case the pattern will also be increased in height by a number which instead of being only equal to the number of feeds is in fact the number of feeds multiplied by the number of turns about the cylinder before the initial conditions are again reached.

This characteristic of making a different selection at each revolution by other teeth in the drum represents an essential characteristic of the present invention. However a solution based only on this characteristic would have certain disadvantages, whether used on machines for closed tubular fabric or on machines for open tubular fabric. Because of the phase displacement which takes place at each revolution of the drum about the cylinder, the pattern is no longer repeated exactly above or below the previous one but is displaced diagonally with respect to this latter. This can be tolerated for some patterns but not for others.

Consequently the present invention not only provides a circular knitting machine with which it is possible to increase the size of the pattern, but also a machine for obtaining a worked knitted fabirc in which the phase of the pattern is not diagonally displaced.

This object is attained according to the invention by a circular knitting machine for manufacturing knitted fabrics with a device for increasing the size of the pattern obtainable on the fabric, comprising a needle cylinder provided with needles and needle pushers or jacks and at least one pattern drum disposed peripherally with respect to said cylinder and provided with a plurality of variously disposed teeth for operating the selection of the needle pushers and needles according to the pattern to be reproduced, said drum being disposed to roll on said cylinder and having said teeth disposed at a pitch equal to that of needles of said cylinder, comprising means for driving said drum which give it a rotational speed about its own axis and a revolving speed about said cylinder such that two generatrixes of the cylinder and drum facing each other at a given time become mutually phase displaced after each complete revolution of the drum about the cylinder, and means for returning the drum to the condition in which said generatrixes are facing each other after the completion of a determined number of revolutions of the pattern drum about the needle cylinder.

BRIEF DESCRIPTION OF THE DRAWINGS

Further characteristics and advantages of the invention will be more evident from the description given hereinafter of a preferred embodiment, given by way of example and illustrated in the accompanying drawings in which.

DESCRIPTION OF THE PREFERRED EMBODIMENTS

The machine considered is a circular machine of large diameter for manufacturing open tubular fabric, i.e. a knitted fabric which begins and ends on respective spaced apart generatrixes of the cylinder needle, the generatrixes being intended as already defined. This machine has its cylinder fixed and the cams rotating about the cylinder. It also comprises a zone not provided with needles, in which the fabric is not worked and is therefore not closed in tubular form. The machine, therefore, has a needle cylinder with a needle fitted out portion and a needle free portion.

Figure 1:
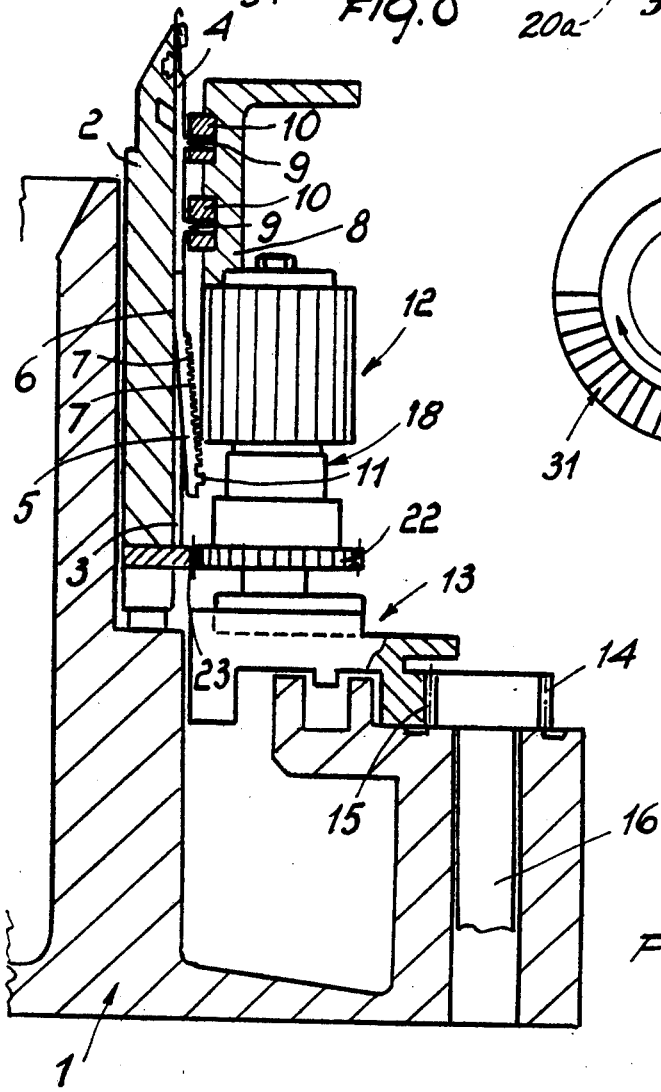
FIG. 1 is a partial axial section through a first embodiment of the machine according to the invention.

The circular knitting machine comprises a base 1 on which the needle cylinder 2 is arranged, provided with grooves 3 for the needles 4, which are slidable in these grooves controlled by the needle pushers or selector jacks 5. These are slideably disposed in the grooves 3 and oscillate about the corner 6 which defines the oscillation pivot, so that they can be respectively pressed into the grooves 3 (FIG. 3), in which case they are not raised by the control cams, or can be brought out of these grooves (FIGS. 1 and 2), in which case they are operated by the cams and raise the needles. In fact, these control cams are so spaced from the needle cylinder that they engage only the butts 11 of the projecting jacks 5. The needle pushers are each provided with a single butt 7 (the other have been broken on insertion of the needle pushers into the cylinder grooves), and are disposed in such a manner that their butts lie on a diagonal along the development of the cylinder circumference. In the described example, groups of 24 adjacent needles are considered which form diagonals of 24 needles, and each group defines one selection unit. FIG. 1 also shows the cams 8 for controlling the needles 4 by way of the butts 9 which engage with the cams 10, and for controlling the lower butts 11 of the needle pushers 5 when the needle pusher is not pushed into the groove 3.

A pattern drum 12 is provided for pushing the needle pushers 5 into the grooves 3, and is rotatably mounted on a rotating support structure 13 which extends about the cylinder 2 coaxially with it, and is rotated about it by the gear wheel 14 which engages with a ring gear 15 on the rotating structure, and is driven by the shaft 16 connected to drive means, not shown.

Figures 2, 3:
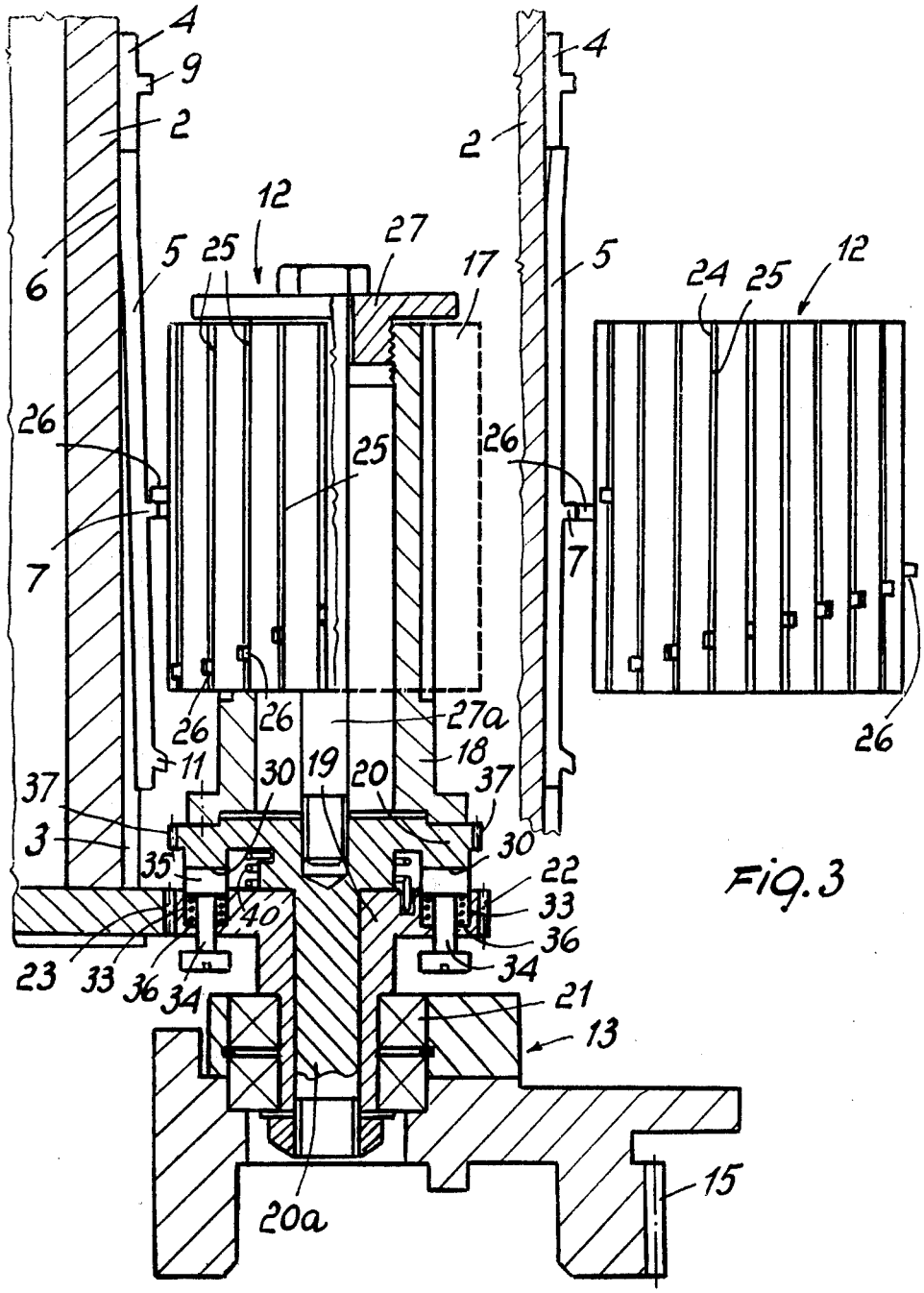
FIG. 2 is a detailed view in an enlarged scale of a drum and its drive system in a second embodiment of the machine according to the invention.
FIG. 3 is a diagrammatic illustration of the method of operation of the drum with one of the teeth engaged with a butt of a needle pusher.
Figure 4:
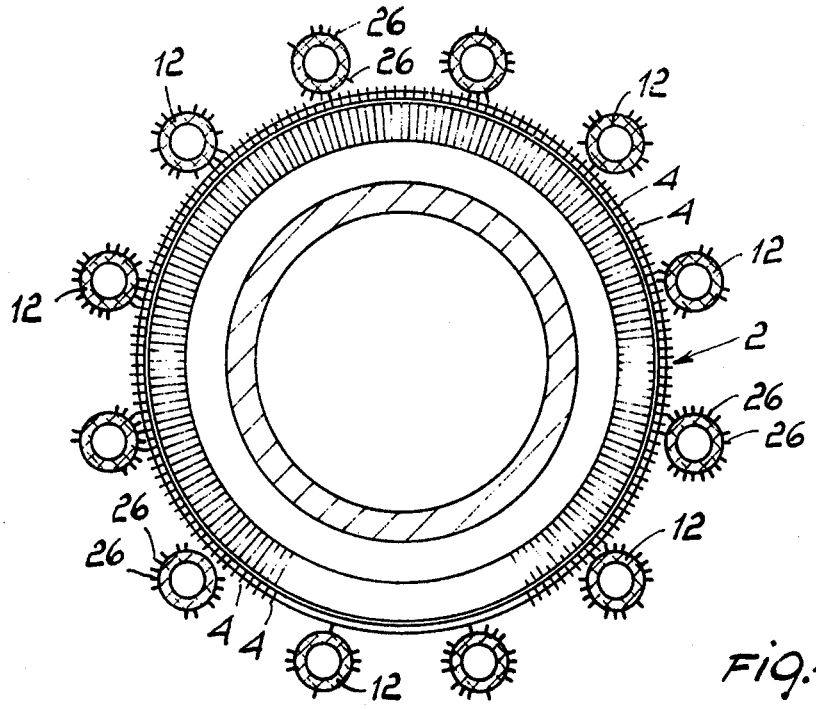
FIG. 4 is a diagrammatic view of the machine from above in which its upper part has been omitted, the machine being of the type of forming open tubular fabric.

The rotating support structure 13 carries a number of said drums 12, for example 12 drums as shown in FIG. 4. Each drum is formed from a hollow cylinder 17 mounted on a tubular support element 18 rotatably associated with the rotating structure 13. In the embodiment of FIG. 2, the element 18 is supported by the flanged sleeve 19 by way of a disc 20. The sleeve 19 is rotatably mounted by way of bearings 21 on the rotating structure 13 and comprises a ring gear 22 engaging with a further ring gear 23 disposed in a fixed manner about the cylinder 2. The support element 18 is connected in a rotatably rigid manner with the disc 20, this latter having an axle 20*a* which penetrates ijnto the sleeve 19 and is coupled to it by friction In this manner, when the rotating structure 13 is rotated about the cylinder 2 by means of ring gear 15 which is driven by shaft 16 through gear wheel 14 as shown in FIG. 1, the drum 12 also moves not only about the cylinder but in addition rotates about itself because of the peripheral toothing 22 and 23. The embodiment shown in FIG. 1 differs from that now described in that the disc 20 of the embodiments of FIG. 2 is not included and the support element 18 is connected directly to the ring gear 22 rotatably rigid with it.

According to the invention, the outer periphery of the hollow cylinder 17 comprises a number of longitudinal grooves 24, in which bars 25 comprising a number of teeth 26 are fixed. Thus when the drum is complete, it comprises a number of teeth 26 projecting peripherally and disposed along vertical lines in accordance with a precise pattern depending on the pattern which is to be obtained on the fabric. The figures show only some teeth disposed diagonally for greater clarity. However each bar 25 may comprise a number of variously disposed teeth (in the case considered the maximum number is 24, as this represents the number of butts of each group of 24 adjacent needle pushers 5).

The hollow cylinder 17 is removably mounted on the support element 18, but is rotationally rigid with it. The element 18 is closed by a cover or plug 27 by means of a bolt or the like 27*a* which is screwed into the disc 20. The pitch of the grooves 24, i.e. the distance between two adjacent vertical lines on which teeth 26 are disposed, is equal to the pitch of the grooves 3 of the needles of the cylinder 2. When the teeth 26 encounter a butt 7 during rotation of the drum, they act on this butt in the sense of pushing it together with the respective needle pusher into the cylinder grooves. The needle pusher is then returned outside the groove, before each drum, by known means, not shown. The needle pusher pushed into the groove does not carry the respective overlying needle into working action. On the other hand, the needle pusher not pushed into the groove acts on the respective needle under the action of the respective cams. In this manner the necessary selection for obtaining the pattern on the produced fabric is made by means of the drum.

Figure 5:
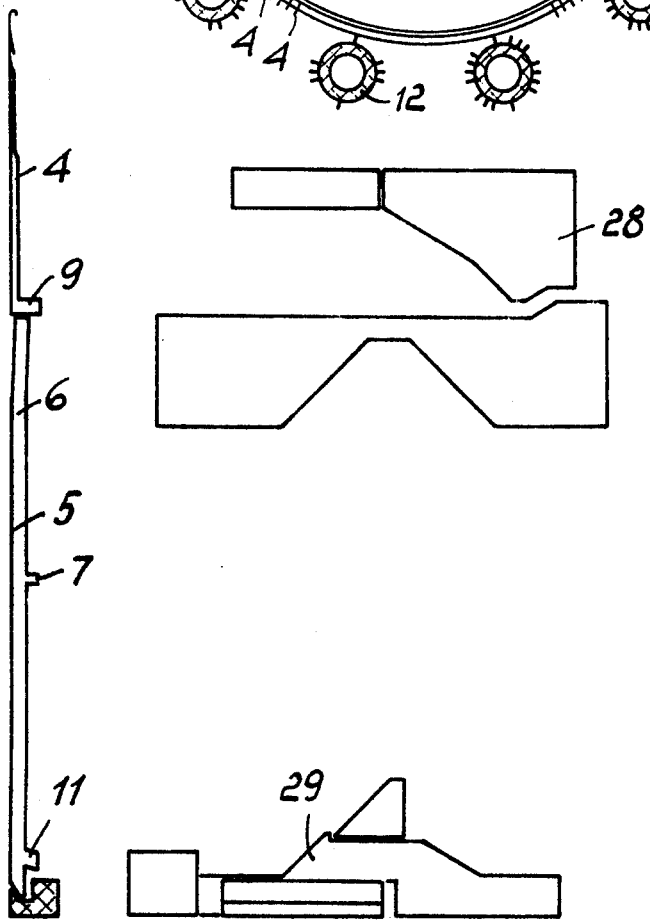
FIG. 5 is a cam system for controlling those needle pushers not selected by the drum teeth.

The operating cams for the needle pusher are visible diagrammatically in FIG. 5. The cam 28 acts on the butt 9 of the needle 4 in order to lower it while that indicated by 29 acts on the terminal butt 11 of the needle pusher 9 to raise the neelde pusher and the corresponding needle 4.

For greater clarity, reference will now be made to an embodiment in which each drum comprises $24 \times 4 = 96$ bars 25.

Figure 6:
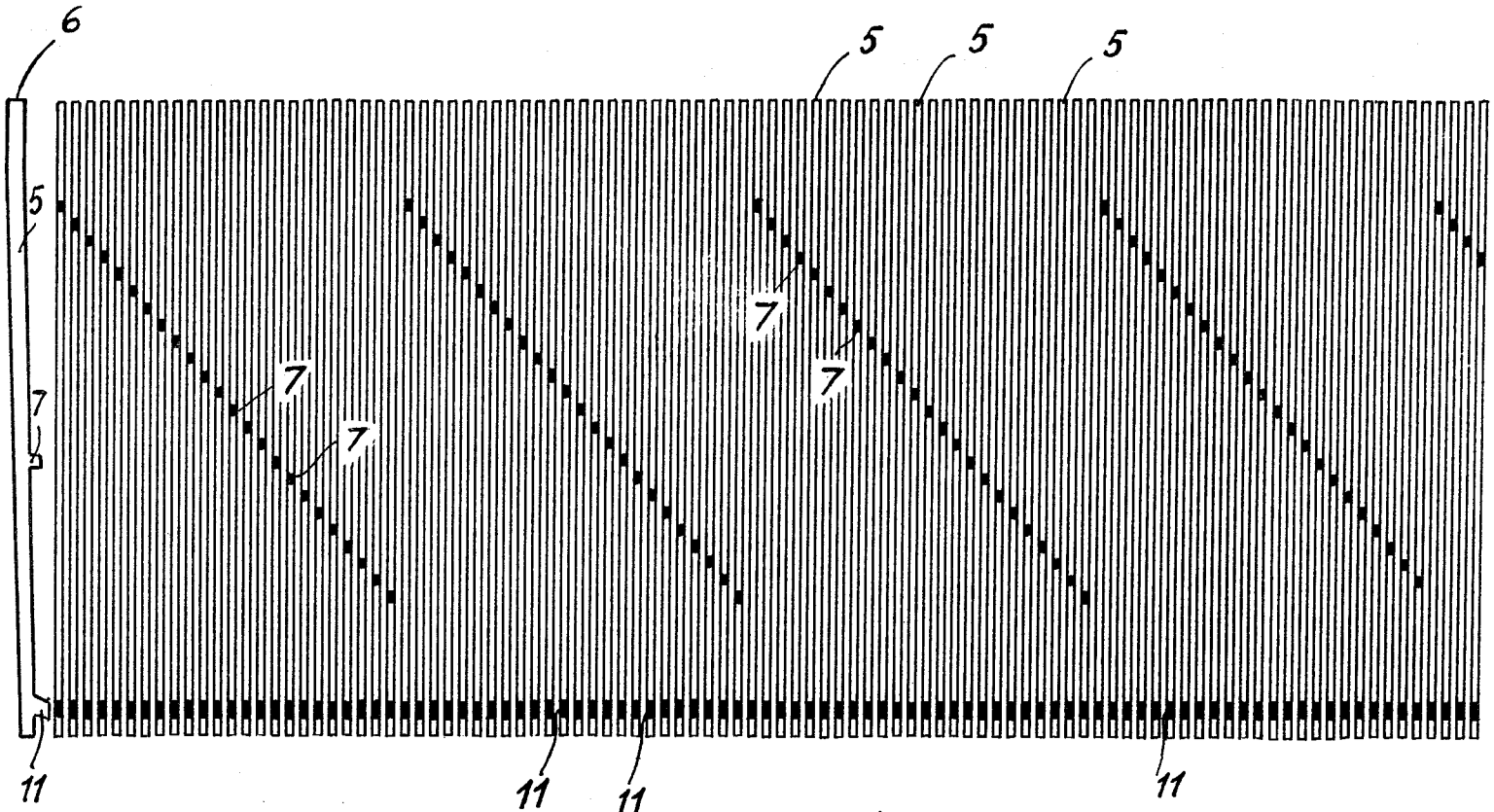
FIG. 6 shows the arrangement of the needle pushers in the cylinder grooves with the corresponding butts disposed diagonally.
Figure 7:
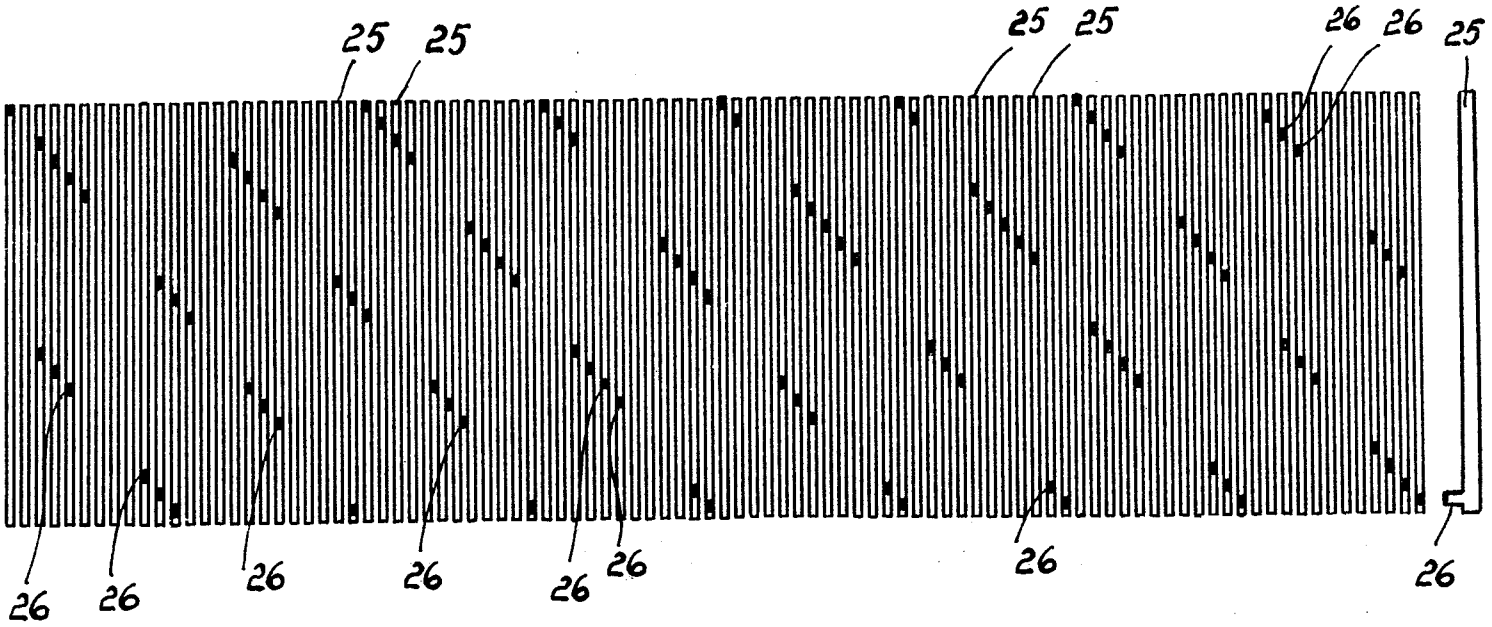
FIG. 7 is a development of the drum indicating some teeth disposed exclusively along diagonals in an illustrative form.

Reference should also be made in this respect to FIGS. 6 and 7. Each bar comprises a maximum number of 24 teeth 26. Some may be missing according to the pattern to be obtained. As the butts of the needle pushers are disposed diagonally, the teeth which are disposed diagonally on the drum provide the selection of the pushers. In FIG. 7 only a small number of teeth has been shown and these have been arranged diagonally to better clarify that the diagonally arranged teeth cause the selection of the adjacent needle jacks.

Along each of these diagonals there will be teeth and empty spaces, i.e. without teeth, according to the pattern, so that each diagonal will produce its own particular selection. As previously stated, after each turn about the cylinder 2, the drum must present a different generatrix facing the initial reference generatrix of the cylinder. This is done according to the invention in two different ways.

According to a first embodiment, the cylinder has a number of grooves, and hence needles, which is not an exact multiple of the number of grooves of the drum. In this case 383 needles will be considered, i.e. for simplicity $96 \times 4 = 384 - 1 = 383$, i.e. one needle less than the number of grooves of a drum multiplied by 4. This number is taken purely for example and is small for reasons of simplicity, it being noted that large diameter machines usually have more than one thousand needles.

Considering now a single drum and a single feed, and the case in which the missing groove or removed needle is at the end of the cylinder, there will be a first active diagonal of the drum on the first turn about the cylinder, while on the next turn of the drum it will not be the same first diagonal which acts on the previous butts of the needle pushers but the diagonal adjacent said first diagonal. Needle number 1 now engages the 96th pattern tooth. Selection continues in this manner for 24 turns during which all the diagonals of the drum have been active only once, and at this stage a selection will have been made which is 96 needles wide, i.e. much greater than that possible with only 24 conventional butts and selectors, in 24 turns. The pattern will therefore be much wider and will comprise $96 \times 24 = 2304$ stitches. The pattern will be 96 needles wide and 24 rows high. If the needles would be in a number multiple of the number of grooves of the pattern drum, for instance 384, the pattern would be 96 needles wide but only one row high since the same selection would be repeated at each revolution of the pattern drum around the needle cylinder, that is at each row of knitting, because the same diagonal would always act on the butts 7. Removing one or more needles so that the number thereof is not multiple of that of the grooves of the pattern drum at each revolution of the pattern drum around the needle cylinder a different diagonal, which has differently arranged teeth, acts on the butts 7 of jacks 5, so causing a different selection to be made. A number of different courses are therefore knitted (in the example described these are 24), thus having the result of widening the pattern in the vertical direction of the fabric.

It has been assumed that a needle pusher is removed at then end of the cylinder, but it is also possible to remove a needle pusher along the cylinder development, for example the 96th needle pusher starting from a predetermined point. In this case the selection of the first 95 needles at the first revolution of the pattern drum will be equal to the selection of the previous first 95 needles in the case, but from the 96th needle onwards until the 191st $(95 + 96)$ there will be a different selection, namely that which was obtained on the second revolution in the previous case. In this case there will be an even greater increase in size of the pattern, but this will result in the height being reduced to one half, as two selection diagonals of the drum have been utilised before completing the turn about the cylinder. It is also necessary to introduce a needle pusher with a butt outside the diagonal to compensate for the one removed. This needle pusher may be added as the 192nd needle pusher and will make a stitch to be established according to the chose pattern.

In this manner other possible situations can evidently be chosen by removing a needle at other points of constant pitch on the cylinder, to obtain different patterns. The overall size of the pattern (height multiplied by width) will however remain as that initially stated because of the number of drum diagonals and the number of butts of one diagonal.

Only one drum and one feed have been considered up to the present time. Taking the case for example of 12 drums (FIG. 4) and 12 feeds, the concept is the same but there will be an elongation of the pattern proportional to the number of feeds.

In this respect, the number of stitches worked by 12 feeds is 12 times greater than the number obtainable by a single feed and drum. This is valid if not more than one colour is worked, otherwise there is a reduction of one-half, one-third etc. of the stitches (and hence of the pattern) if the number of colours worked is two, three etc. respectively. Thus, for a pattern of equal width, the pattern is reduced by one half, but is always proportionally greater than that obtainable by selecting with selection levers of the traditional type.

The increase in pattern due to the increase in the number of drums is obtained when each drum carries its own pattern different from that of the other drums.

In the second embodiment of the invention, the cylinder has a number of needles which is a multiple of the number of drum grooves, or comprises a number of needles such that, including the zone free from needles which is provided in the knitting machine herein considered, as specified hereinbefore, and along which the drum continues to ratate, the drum after having completed one revolution around the needle cylinder arrives at its initial reference point without phase displacement between two reference genertrixes facing each other on the cylinder and the pattern drum at said reference point at the beginning of said revolution. In this case the device illustrated in FIGS. 8, 9 and 10 in addition to 2 is advantageously used, in order to make the drum arrive at the next turn with the necessary phase displacement so that all the diagonals of teeth gradually have caused a corresponding selection of jacks 5.

Figure 11:
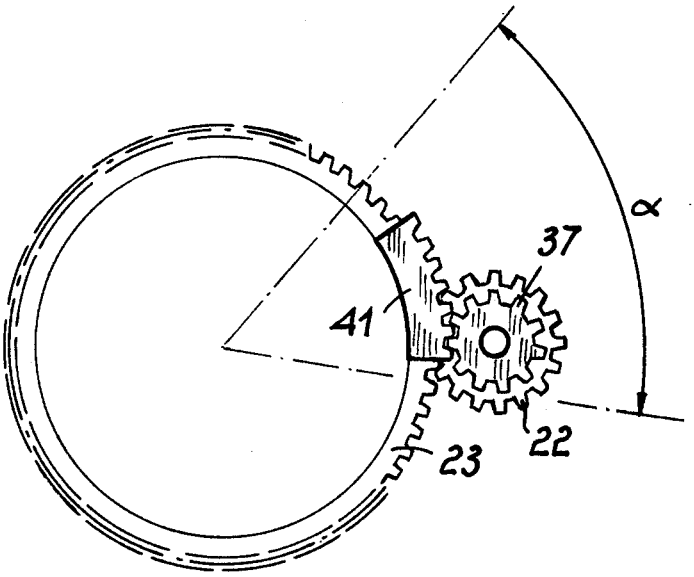
Figure 12:
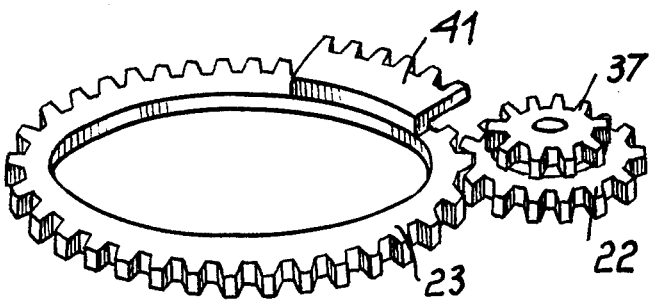

This device comprises an annular projection 30 defined below tha disc 20 and provided with diametrically opposing toothed zones 31 with triangular teeth 32. These zones extend substantially for less than one quarter of the circumference and each comprise 12 teeth, but this number could be different. In the flanged sleeve 19 there are two diametrically opposing seats 33 for the latches 34 (FIG. 2), which each have one end of triangular profile 35 so as to exactly penetrate between two consecutive teeth 32 of the respective toothed zones 31. Between the end 35 and bottom of the seat 33 is inserted a pressure spring 36, which pushes the latches 34 against the toothed zones 31. The flanged sleeve 19 also includes an external peripheral toothing 37, which has a diameter slightly less than the diameter of the ring gear 22 and engages with a tooth sector 41, shown in FIG. 11 and 12, arranged above toothing 23 of the cylinder in the section therefore free from needles at a height corresponding to the peripheral toothing 37. This needle free section extends for example ove- an arc defined by an angle $\alpha$(FIG. 11). The teeth 32 have a pitch double that of the grooves 24 of the drum, for purely constructional reasons. The overall arrangement is such that when a latch 34 engages exactly in the space between two teeth 32, the other latch is halfway betwen one tooth and the other, and is thus not engaged with them. The tubular support element 18 is rotatably connected to the disc 20.

Figure 8:
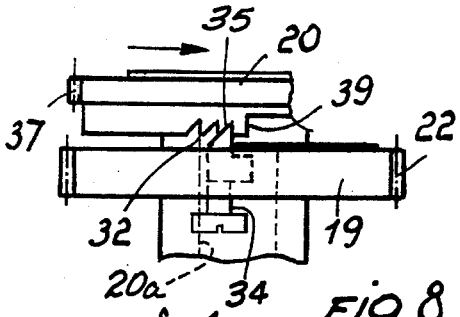
FIGS. 8, 9 and 10 show certain details of the drum of FIG. 2, having a width in terms of stitches equal to the maximum number of teeth of a disc of the pattern drum.
Figure 9:
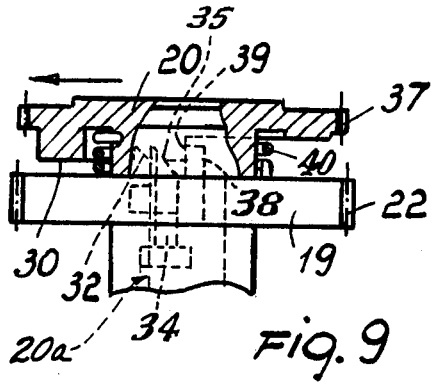

During rotation of the drum about the cylinder, when the zone without needles is reached, the ring gear 37 engages with the aforementioned sector 41. This leads to a phase displacement of the drum by an amount of one groove, because the small difference between the diameters of the gears 22 and 37 causes the disc 20 to rotate slightly faster than the sleeve 19 while both rotate about the cylinder in the needle free section. This is sufficient to make the latch 34 not engaged with the teeth 32 (i.e. that between one tooth and another) snap into the space between two immediately adjacent successive teeth, while the other latch rises into the intermediate position. The direction of displacement of the teeth of disc 20 is indicated in the figures. The arrows are arranged opposite since FIG. 8 shows the teeth of one group 31 from outside and FIG. 9 shows the teeth of the other group 31 as they appear when disc 20 is sectioned with a plane parallel to its axis. Rotation in the opposite direction is prevented by the shape of the teeth 32 and ends 35. In this manner, for each rotation of the drum about the cylinder, the drum rotates about itself through one pitch, so as to offer a different diagonal to the needle pushers 5 each time.

As manufacture proceeds, the disc 20 advances by one groove unitl the 24th turn. At this point the drum must be returned to zero, i.e. it must be turned backwards by one quarter of a turn, otherwise the pattern would continue with a phase displacement of 24 needles, as initially stated.

Figure 10:
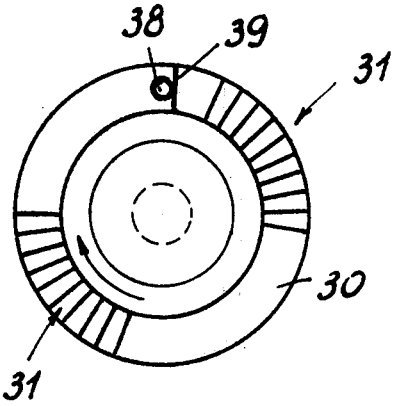

FIGS. 9 and 10 show a pin 38 rigid with the flanged sleeve 19, this pin defining the zero or reference position of the disc 20 and hence that of the drum, in that the shoulder 39 of the annular projection 30 rests against it when the disc 20 is in the zero position. The engagement between the pin 38 and shoulder 39 serves to rotate the disc 20 and hence the drum 12 when this latter is in the zero position. This engagement is maintained by a torsion spring 40. For each turn about the cylinder, the disc 20 advances with respect to the sleeve 19 by means of engagement of toothing 37 with sector 39 as described hereinbefore and schematically shown in FIGS. 11 and 12 and thus the shoulder 39 becomes gradually displaced from the pin 38. The rotational engagement between the sleeve 19 and disc 20 is not exclusively entrusted to one of the latches 34, namely that inserted between two consecutive teeth 32 (FIG. 8). This is valid unitl the 24th turn has been completed, and then it is necessary to turn the drum back so that the pattern for the next row is not out of phase with the previous one. For this purpose it is sufficient to withdraw the latches 34 by an appropriate control, which is not shown but is easy to construct and which causes the latches 34 to be simultaneously pulled downwards against the action of springs 36 (FIG. 2). The disc 20, which is acted upon by the said torsion spring 40 arranged between the disc 20 and sleeve 19, is rotated backwards by this spring until the shoulder 39 again hits against the pin 38 and the initial conditions are re-established (FIG. 9).

In this manner the problem of displacement of the pattern in diagonal direction on the fabric which always occurs when the pattern is wider than the number of diagonally disposed butts, i.e. the number of needles provided in each group, which in the case considered is 24, is also solved. Advantageously, this rephasing can be accomplished in the machine for manufacturing open tubular fabric in the needle free zone, during the revolving of the drum about the cylinder.

In the first embodiment case has been illustrated in which the cylinder has a number of teeth which is one less than a multiple of the number of grooves in the drum. However the difference between the number of needles and the number representing the multiple of the grooves in the drum can be greater than one, and the cylinder may have a number of needles which is one, or more than one, greater than the multiple of the number of grooves in the drum. Likewise, the phase displacement, which in the second described embodiment is achieved by partially rotating the drum relative to the needle cylinder each revolution of the drum around the needle cylinder, can be equivalent to more than one pitch, provided that after a certain number of revolutions of the drum about the cylinder, the initial conditions are re-established for repeating the pattern.

The embodiment of the drum in cylindrical form with grooves in which bars carrying the teeth are inserted and fixed is particularly convenient for changing the pattern, as it is possible to quickly replace the bars with others set for a new pattern.

The invention is susceptible to numerous modifications, all of which fall within the scope of the inventive idea. Thus it is possible to provide a different phase displacement system for the drum, for example with a single mobile pawl engaged with a toothed peripheral portion disposed underneath the drum.

The number of feeds or drums may be different from the number considered, and the number of drums may be greater than the number of feeds.

The invention can also be advantageously applied to machines with a rotating cylinder and fixed cams.

I claim:

1. A circular knitting machine for manufacturing knitted fabrics having a pattern thereon, comprising a needle cylinder having longitudinal grooves and needles and selector jacks slidable within a number of said grooves, thereby difining a needle fitted out portion of said needle cylinder and a needle free portion thereof, said selector jacks being grouped in groups around the needle cylinder and each having a butt, the butts of adjacent selector jacks of each group being arranged at different heights, at least one pattern drum disposed peripherally with respect to said needle cylinder and provided with a plurality of pattern teeth for engagement with said butts to cause selection of the needles according to the pattern to be reproduced on the fabric, said at least one pattern drum having said pattern teeth disposed along vertical lines spaced by an extent equal to the distance between two adjacent needles of said needle cylinder, a support structure rotatably arranged around said needle cylinder and rotatably supporting said at least one pattern drum, means for rotating said support structure, means for causing said at least one pattern drum to revolve relative to said needle clinder during rotation of said support structure around said needle cylinder, means at said needle free portion of said needle cylinder for partially rotating said at least one pattern drum relative to said needle cylinder after a relative revolution of said at least one pattern drum about the circumferential extent of said needle fitted out portion of said needle cylinder so as to cause a given pattern tooth of said at least one pattern drum engaging a selector jack at a given time to become phase displaced with respect to said selector jack by an extent at least once the distance between two adjacent needles after a complete relative revolution of said at least one pattern drum about the whole circumferential extent of said needle cylinder, and means for resetting said at least one pattern drum and said needle cylinder in the condition in which said given selector jack newly engages said pattern tooth after a determined number of relative revolutions of said at least one pattern drum about said needle cylinder.

2. A knitting machine as claimed in claim 1, in which said means for causing said at least one pattern drum to revolve relative to said needle cylinder comprise a peripheral toothing on said needle cylinder and a ring gear below said at least one pattern drum engaging with said peripheral toothing; and in which said means for partially rotating said at least one pattern drum relative to said needle cylinder comprise a disc arranged below said pattern drum rigid therewith, an element arranged below said disc and provided with said ring gear, said disc being provided with a peripheral toothing having a diameter slightly less than that of said ring gear, a fixed toothed sector arranged on said needle cylinder at said needle free portion for cooperation with said peripheral toothing of said disc at each relative revolution of said pattern drum about said needle cylinder, and means for locking said pattern drum after each said partial rotation with respect to said element provided with said ring gear, said locking means comprising at least one toothed portion on said disc and a latch for engagement between adjacent teeth of said at least one toothed portion after each said partial rotation.

3. A knitting machine as claimed in claim 2, further comprising means for disengaging said latch from said teeth of said at least one toothed portion and a torsion spring between said disc and said element for resetting said pattern drum with respect to said element in the arrangement before initial of said partial rotations.

* * * * *